US005582554A

United States Patent [19]

Stryczek

[11] Patent Number: 5,582,554

[45] Date of Patent: Dec. 10, 1996

[54] GOLF ACCESSORY FOR INDICATING A NATURAL BREAK COMPONENT OF A GREEN

[75] Inventor: Michael E. Stryczek, Phoenix, Ariz.

[73] Assignee: Strystar International, L.L.C., Phoenix, Ariz.

[21] Appl. No.: 572,295

[22] Filed: Dec. 13, 1995

[51] Int. Cl.[6] ..... A63B 57/00

[52] U.S. Cl. ..... 473/407; 473/408; 473/404; 2/160; 2/161.2; 33/334

[58] Field of Search ..... 473/404, 241, 473/407, 408; 33/334, 352; 24/3 R; D21/221; 273/162 F

[56] References Cited

U.S. PATENT DOCUMENTS

| | | | |
|---|---|---|---|
| D. 226,203 | 1/1973 | Gibbs et al. | D34/5 GC |
| D. 266,445 | 10/1982 | Yokotaki | D21/221 |
| 2,597,212 | 5/1952 | White et al. | 33/334 |
| 3,744,714 | 7/1973 | Banner | 235/88 |
| 4,162,071 | 7/1979 | Fish et al. | 273/33 |
| 4,482,155 | 11/1984 | Higley | 33/334 |
| 5,174,572 | 12/1992 | Ho | 473/241 |
| 5,379,491 | 1/1995 | Solo | 24/3 R |
| 5,476,258 | 12/1995 | Frisone | 473/404 |

OTHER PUBLICATIONS

America West Arrivals—Fall, 1995, p. 14.

"The Gim-me Putter", Advertisement, Gifts Catalog, Fall/65 Spring/66, p. 8 Jul. 1966.

*Primary Examiner*—Mark S. Graham

*Attorney, Agent, or Firm*—James H. Phillips

[57] ABSTRACT

A device for ascertaining the natural break to the west of a golf green is obtained by the incorporation of a compass with an existing golf implement in accordance with one or more of a plurality of embodiments. The compass includes indicia indicating west, the direction of the natural green break, and, in one preferred configuration, the indicia directly indicates only west. The several embodiments disclosed and discussed include the combination of a compass and a golf glove, a compass and a ball marker, a compass and a golf club (in variant configurations) as well as broadly adaptable compass golf accessory embodiments which include special purpose structure by which the break finder may be removable or permanently fixed to a golf implement.

2 Claims, 2 Drawing Sheets

GOLF ACCESSORY FOR INDICATING A NATURAL BREAK COMPONENT OF A GREEN

FIELD OF THE INVENTION

This invention relates to the game of golf and, more particularly, to a golf accessory for indicating a natural break component of a green.

BACKGROUND OF THE INVENTION

Golf enthusiasts range in ability from the beginning duffer to the highly skilled touring professionals who have become household names. However, all golfers face the same fundamental task when playing a course; viz., to complete a round using the fewest number of strokes within the capability of the golfer. For the beginning golfer, there are numerous basic skills to develop including driving, fairway play, playing out of traps and putting.

As a golfer becomes more skilled, nuances of the individual aspects of play, which at first are entirely ignored, become increasingly relevant as the golfer strives to improve his/her game. Putting is an area in which such variables as distance, green condition, grass height, slope, undulations overall natural break, windage, etc. between the ball position and the hole which must be mentally taken into account and "algebraically summed" as a golfer prepares to stroke the ball, usually in a direction somewhat offset from a straight shot because of these variables.

A subtle factor in the natural break which a ball may follow during its traverse toward the hole following a putting stroke is the fact that, all other things being equal, greens break to the west. This factor, sometimes identified as first expressed by the immortal Ben Hogan, is often omitted from the golfer's mental appraisal of a putting shot for either of two reasons: the golfer is unaware of the factor or it is difficult to determine dead west in the context of the immediate positions of the ball and the hole on a particular green.

Given that many golfers are aware of the natural western break factor and wish to take it into account for each relevant putting stroke, it is apparent that it would be highly desirable to provide a convenient expedient for determining the direction of dead west at any position on any green during a round of golf, and it is to this end that the present invention is directed.

OBJECTS OF THE INVENTION

It is therefore a broad object of this invention to provide a golf accessory by the use of which dead west may be determined preparatory to undertaking a golf putting stroke.

It is a more specific object of this invention to provide such an accessory which is convenient, unobtrusive and readily read and understood.

In another aspect, it is another more specific object of this invention to provide such an accessory which is simple and economical to fabricate.

In yet another aspect of the invention, it is a more specific object of this invention to provide such an accessory which may take diverse forms including some in which it is incorporated integrally with an existing golf accessory or apparatus such as a club.

SUMMARY OF THE INVENTION

Briefly, these and other objects of the invention are achieved by incorporating a compass with a golf implement in accordance with one or more of a plurality of embodiments. The compass includes indicia indicating west, the direction of the natural green break, and, in one preferred configuration, the indicia directly indicates only west. The several embodiments disclosed and discussed include the combination of a compass and a golf glove, a compass and a ball marker, a compass and a golf club (in variant configurations) as well as broadly adaptable compass golf accessory embodiments which include special purpose structure by which the break finder may be removably or permanently fixed to a golf implement.

DESCRIPTION OF THE DRAWINGS

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DESCRIPTION OF THE PREFERRED EMBODIMENT(S)

Figure 1:
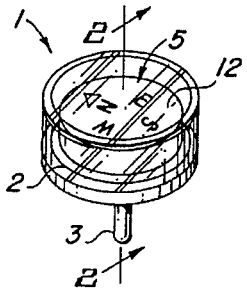
FIG. 1 is a perspective view of a first embodiment of my invention.
Figure 2:
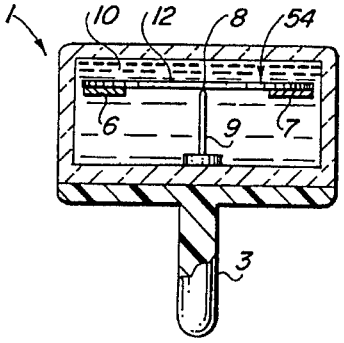
FIG. 2 is a cross sectional view of the first embodiment of my invention taken along the lines 1—1 of FIG. 1.

Attention is first directed to FIGS. 1, 2, 3 and 4 which illustrate a first embodiment of my invention and which reveal an important variant configuration for one component which is equally applicable to all embodiments of my invention. As best shown in FIGS. 1 and 2, a ball marker, generally indicated at 1, is shown. The ball marker 1 includes a generally cylindrical housing 2 and a downwardly depending, axially positioned finger 3. As is well known to those familiar with the game of golf, such a ball marker may be employed to temporarily mark the immediate position of a ball in play on a green in order that the player can, within the rules, pick up the ball for inspection and cleaning, if necessary. The marker is simply pushed into the correct position with the finger extending into the turf to hold it in place until it is removed and replaced with the ball.

Disposed within the housing 2 is a compass 5. Referring particularly to FIG. 2, the compass 5 is supported for rotation, in accordance with the earth's magnetic field interacting with magnets 6, 7, about a central pivot point 8 which rests on needle support 9, all in the well known manner. Preferably, the compass 5 is damped by a fluid 10 contained within the housing.

Figure 3:
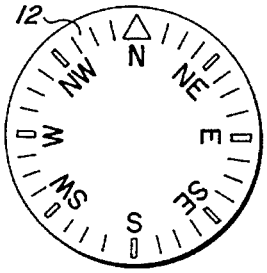
FIG. 3 (PRIOR ART)
FIG. 3 is a top view of the first embodiment of my invention, but applicable to all embodiments, showing a first indicia layout which may be employed.

Indicator disk 12 is provided on the upper surface of the compass 5 to provide an indication of direction as established by the earth's magnetic field. As best shown in FIG. 3, the indicia on the disk 12 may take the conventional form in which the various directions are indicated with North sometimes emphasized. However, in accordance with one important variant of my invention, it is desirable to provide an unmistakable indication of the direction west which can be readily perceived even from a distance of several feet. Thus, referring to FIG. 4, a variant configuration for the indicia is illustrated. The special purpose indicator disk 13 carries a prominent figure, such as the exemplary broad arrow 14, which is oriented with respect to magnets 6, 7 such that the broad arrow 14 directly indicates to the user only dead west. In order to improve readability from a distance of several feet, the broad arrow 14, or its functional equivalent as may be selected, is preferably rendered in a bright color such as red or orange.

In use, when a player's ball reaches the green, the marker 1 may be used to temporarily mark the ball's position in the usual manner. At this time, if permitted under the rules of play in effect, a reading of the compass 5 may be taken by the player through the transparent window 4 to determine the direction of dead west. It will now be understood why the broad arrow indicia 14 on the indicator disk 13 is preferable to the conventional compass indicia. It can readily be consulted from a standing position to obtain the necessary information which will permit the golfer to take into account the natural western break as a factor in determining the compensated direction in which the ball is to be putted toward, but typically offset from a straight line, the hole.

Figure 5:
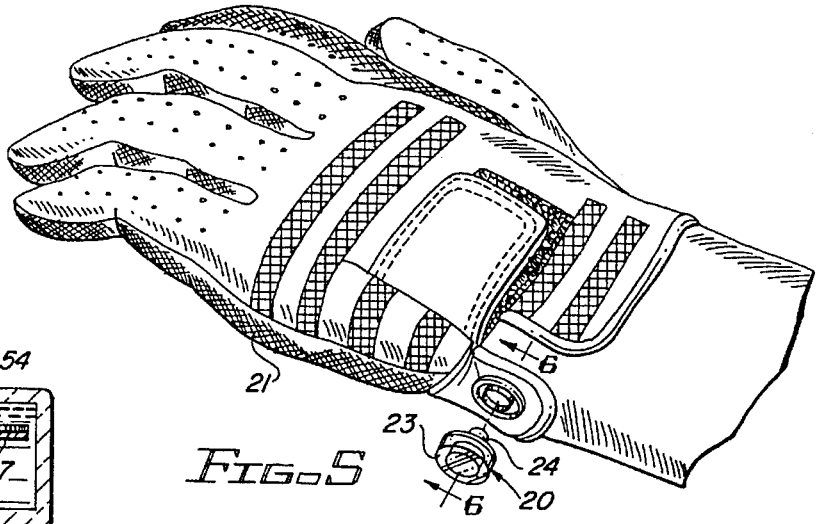
FIG. 5 is a partial pictorial view showing a second embodiment of my invention and its use.
Figure 6:
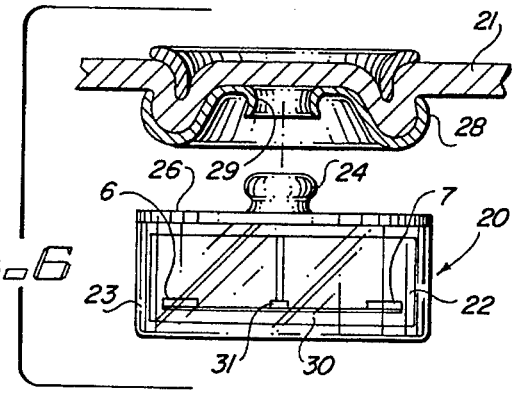
FIG. 6 is a cross sectional view of the second embodiment of my invention taken along the lines 6—6 of FIG. 5.

FIGS. 5 and 6 show another embodiment of my invention in which a break finding compass accessory 20 is adapted to be removably affixed to a golf implement, for example, a golf glove 21. In this embodiment, a compass 22 is contained within a generally cylindrical housing 23, and a first snap element 24 extending axially outwardly from the bottom 26 of the housing. A second snap element 28 is permanently secured to the glove 21 by any suitable means. The second snap element 28, in the example shown, includes a centrally disposed female receiver 29 adapted to admit and detachably hold the exemplary male snap element 24.

In use, if permitted under the rules of play in effect, a player may snap the break indicator 20 onto his/her glove 21 such that, when contemplating a putt, the break indicator 20 may be consulted by rotating the arm to bring the indicator disk 30 into an upwardly facing position at which the compass 22 is free to rotate about pivot point 31 under influence of the interaction between magnets 6, 7 and the earth's magnetic field to provide an indication of precise direction of the natural break to the west.

It may be noted that the position of the attached break finder accessory is on the side of the hand away from the thumb as illustrated in FIG. 5. This has a certain advantage in that, for most golf gloves, the female snap element 28 is already in place as a component of the glove as manufactured. However, there is also a disadvantage to this particular orientation in that it is not easy to rotate the wrist into position to make the reading. It has been found that the reading step is naturally facilitated by switching the point of attachment for the break finder to the thumb side of the glove. In addition, it is contemplated that this embodiment of the invention can be used as a ball marker such that the break finder may merely be snapped off and used to temporarily replace the ball, a suitable determination of dead west being taken at this time.

Figure 7:
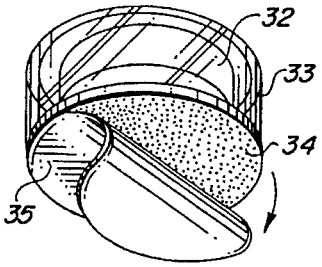
FIG. 7 is a perspective view from below of a third embodiment of my invention.
Figure 8:
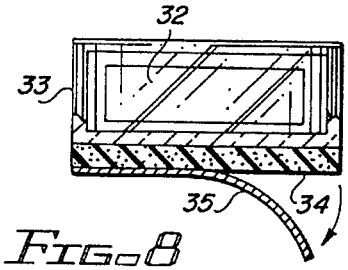
FIG. 8 is a cross sectional view of the third embodiment of my invention taken along the lines 8—8 of FIG. 7.
Figure 4:
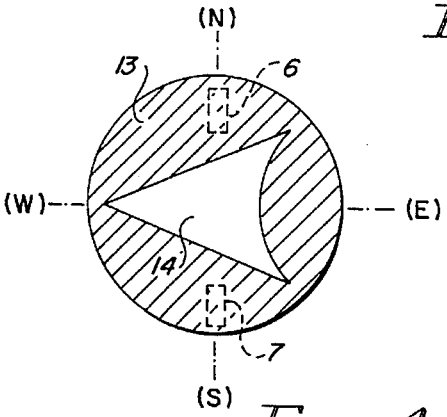
FIG. 4 is an alternative top view of the first embodiment of my invention, but applicable to all embodiments, showing a second and presently preferred indicia layout which may be employed.
Figure 9:
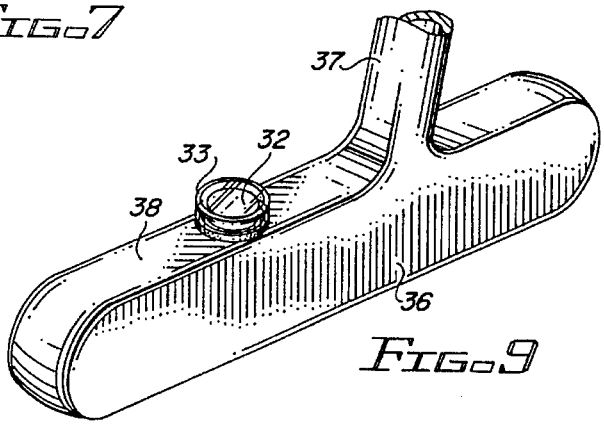
FIG. 9 is a partial pictorial view illustrating one exemplary use of the third embodiment of my invention.

A third embodiment of my invention is shown in FIGS. 7, 8 and 9. In this embodiment, a break finder accessory containing a compass 32 which, as before, is disposed within a housing 33 which, in this embodiment, is provided with an adhesive layer 34 applied to a bottom surface thereof. In a presently preferred configuration for this embodiment of my invention, the adhesive layer 34 may be overlaid with peel away protective cover 35 which is left in place until the break finder accessory is to be more or less permanently affixed to a golf implement. At that time, the peel away cover 35 is removed, and the break finder accessory is pressed into place.

FIG. 9 shows one such use for this embodiment of the invention. A putter head 36, affixed to the lower end of a shaft 37, has an upper surface 38 on which the housing 33 containing the compass 32 may be permanently affixed if permitted trader the rules of play in effect. Preferably, the compass 32 carries the easily read, west indicating only, indicia as exemplified by the broad arrow 14 shown in FIG. 4 in order to permit an easy read by the golfer from a ball-addressing position.

In an equivalent configuration of this embodiment of my invention, conventional complementary hook and loop securement expedients may be substituted for the adhesive 34 and at the point at which the break finder is to be fixed to a golf implement. This configuration enjoys the advantage of rendering the housing 33 removably affixable to a golf implement.

Figure 10:
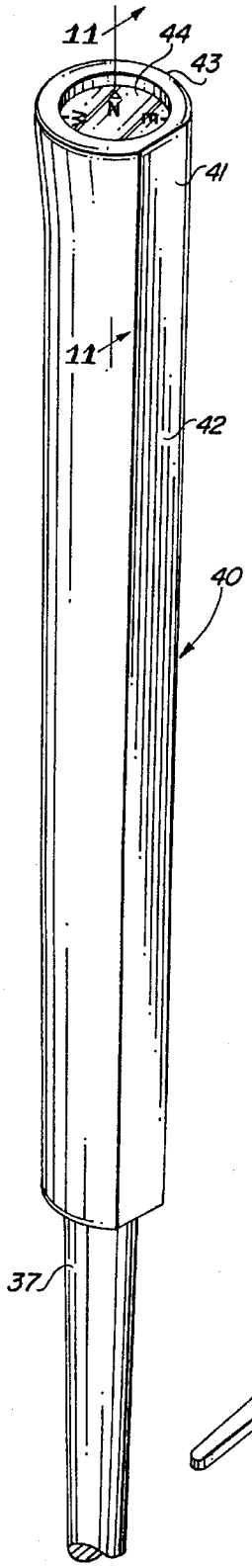
FIG. 10 is a partial perspective view from above of a fourth embodiment of my invention.
Figure 11:
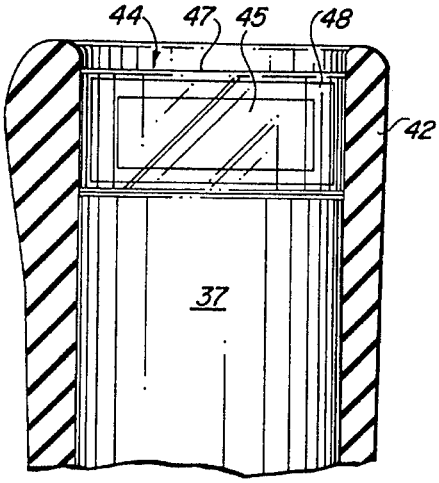
FIG. 11 is a cross sectional view of the fourth embodiment of my invention taken along the lines 11—11 of FIG. 10.
Figure 12:
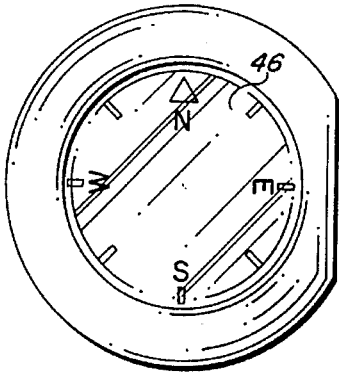
FIG. 12 is a top view of the fourth embodiment of my invention.

FIGS. 10, 11 and 12 illustrate another embodiment of my invention in which a break finder is directly incorporated into the upper end of a putter. Thus, there is shown a putter indicated generally at 40 which includes a shaft 37 having a head end (for example, as shown in FIG. 9) and a grip end 41 which carries a conventional grip 42. At the tip 43 of the grip end 41 of the shaft 37, there is housed a break finder accessory 44. As may best be understood by reference to the cross sectional view shown in FIG. 11, the break finder 44 constitutes a compass 45 disposed within a housing that is a generally cylindrical housing 46. Referring also to FIG. 12, the compass includes an indicator disk 46 which may be viewed through a transparent upper surface 47 of housing 48.

The compass housing 48 is preferably secured to the tip end of shaft 37, for example, with an adhesive, and is encompassed by the grip 42 near its upper terminus such that the indicia on the disk 46 may readily be read by a golfer as the ball is addressed in contemplation of a putt. Therefore, the natural break may be correspondingly taken into account.

Figure 13:
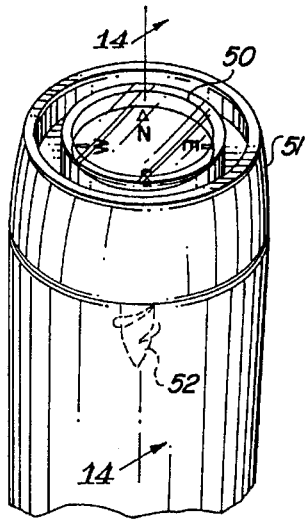
FIG. 13 is a partial perspective view from above of a fifth embodiment of my invention.
Figure 14:
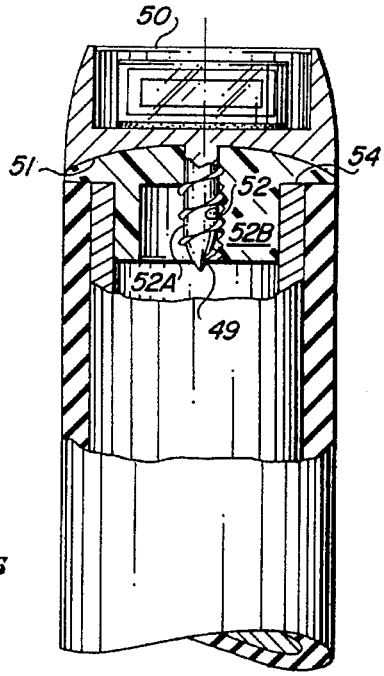
FIG. 14 is a cross sectional view of the fifth embodiment of my invention taken along the lines 14—14 of FIG. 13.

While the embodiment of the invention shown in FIGS. 10–12 may be permanently incorporated into a putter or into the putter grip more or less as shown, a corresponding functional result may be achieved by the utilization of the embodiment of my invention shown in FIGS. 13 and 14. In this embodiment, a compass 50 is disposed within a housing 51. The housing 51 is particularly characterized by an axially directed threaded element 52 which extends outwardly from a bottom surface 53 of the housing 51. The threaded element 52 may be pointed and the threads may be in the traditional wood screw configuration as shown at 52A. The threaded element is sufficiently long as to permit threaded engagement with the upper end of the shaft 54. Alteratively, the threaded element 52 may carry machine screw threads as at 52B, and the upper end 54 of shaft 52 may be correspondingly provided with a centrally disposed, internally threaded cavity (with or without a metal insert) for receiving the machine threads of this version of the threaded element 52.

The result is to removably situate the break finder accessory at the tip end of the putter in order that it can be consulted prior to undertaking a putt to determine the natural break direction component of the compensation the golfer must use to determine the exact direction of the putt. As before, it is preferable that the indicia on the outwardly facing surface of the compass 50 provides an indication of west only although the normal compass indicia may also be used.

It may be noted that the embodiments of the invention shown in FIGS. 10, 11, 12, 13 and 14 may very similarly be affixed to or incorporated with the handle of a golf bag cart or within a golf vehicle. This use may, in some instances, be permitted under the relevant rules of play which preclude the direct incorporation of the break finder into the putter itself or into another golf implement such as the marker or golf glove described above or the golf tool as described immediately below.

Figure 15:
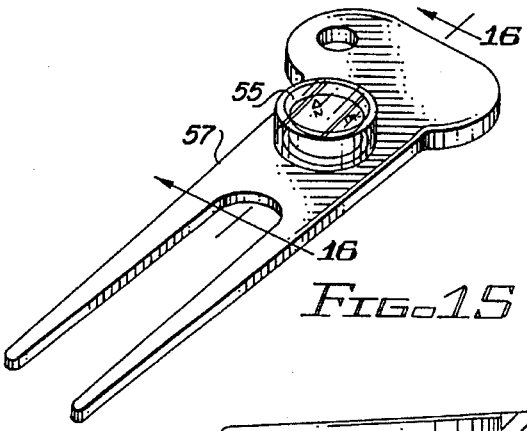
FIG. 15 is a perspective view of a sixth embodiment of my invention.
Figure 16:
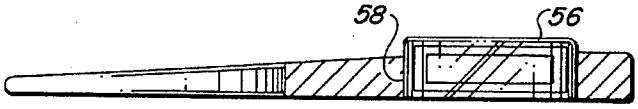
FIG. 16 is a cross sectional view of the sixth embodiment of my invention.

Another embodiment of my invention is illustrated in FIGS. 15 and 16. In this embodiment, a break finder accessory, including a compass 55 disposed in a housing 56, is affixed to another golf implement such as golf tool 57. As best shown in FIG. 16, the compass housing 56 may be secured within a suitable well 58 by an adhesive or the like or it may be affixed to the upper surface of the tool 57 in a manner similar to that shown in FIG. 9 in which the break finder is affixed to an upper surface of a putter head.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A golf accessory comprising:

A) a compass disposed within a housing;

B) means for mounting said compass housing to a golf implement comprising a threaded element extending axially outwardly from the bottom of said housing;

C) indicia on said compass indicating the direction west; and in which:

D) said golf implement is a putter having a head and a shaft, said shaft having a head end and a grip end, and in which said golf accessory is affixed to a tip of said grip end with said indicia facing axially outwardly with respect to said shaft by screwing said threaded element into said tip; and further in which:

E) said tip of said grip end has a convex contour and a bottom surface of said compass housing has a concave contour.

2. The golf accessory of claim 1 in which said indicia directly indicates only the direction west.

* * * * *